US010913990B2

(12) United States Patent
Kim et al.

(10) Patent No.: US 10,913,990 B2
(45) Date of Patent: Feb. 9, 2021

(54) ALUMINUM ALLOY FOAM AND METHOD OF MANUFACTURING THE SAME

(71) Applicant: KOREA INSTITUTE OF MACHINERY & MATERIALS, Daejeon (KR)

(72) Inventors: Su-Hyeon Kim, Changwon-si (KR); Cha-Yong Lim, Changwon-si (KR); Jeki Jung, Busan (KR); Yun-Soo Lee, Changwon-si (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 0 days.

(21) Appl. No.: 16/690,352

(22) Filed: Nov. 21, 2019

(65) Prior Publication Data

US 2020/0165704 A1 May 28, 2020

(30) Foreign Application Priority Data

Nov. 27, 2018 (KR) ..... 10-2018-0148508
Nov. 1, 2019 (KR) ..... 10-2019-0138825

(51) Int. Cl.

| | |
|---|---|
| ***C22C 1/08*** | (2006.01) |
| ***C22C 21/08*** | (2006.01) |
| ***C22C 1/02*** | (2006.01) |

(52) U.S. Cl.

CPC ..... *C22C 1/08* (2013.01); *C22C 1/026* (2013.01); *C22C 21/08* (2013.01)

(58) Field of Classification Search

None

See application file for complete search history.

(56) References Cited

U.S. PATENT DOCUMENTS 5,228,494 A 7/1993 Rohatgi

FOREIGN PATENT DOCUMENTS

JP 2016113681 6/2016

OTHER PUBLICATIONS

KIPO, Office Action of KR 10-2018-0148508 dated Feb. 26, 2020.

*Primary Examiner* — Daniel J. Shleis

(74) *Attorney, Agent, or Firm* — Lex IP Meister, PLLC

(57) ABSTRACT

Provided is aluminum (Al) alloy foam including an Al alloy matrix containing magnesium (Mg), and hollow ceramic spheres dispersed in the Al alloy matrix, wherein a reaction layer including a Mg—Al composite oxide is formed at an interface where the Al alloy matrix is in contact with the hollow ceramic spheres, and wherein a density of the Al alloy foam may be higher at a surface region of the Al alloy foam compared to a middle region of the Al alloy foam.

18 Claims, 8 Drawing Sheets

As

Ac

ALUMINUM ALLOY FOAM AND METHOD OF MANUFACTURING THE SAME

CROSS-REFERENCE TO RELATED PATENT APPLICATIONS

This application claims the benefits of Korean Patent Application No. 10-2018-0148508, filed on Nov. 27, 2018, and Korean Patent Application No. 10-2019-0138825, filed on Nov. 1, 2019, in the Korean Intellectual Property Office, the disclosures of which are incorporated herein in their entirety by reference.

BACKGROUND OF THE INVENTION

1. Field of the Invention

The present invention relates to an aluminum (Al) alloy foam and a method of manufacturing the same and, more particularly, to an Al alloy foam to which magnesium (Mg) is added and which is usable for vehicle bumper systems, building soundproofing equipment, bulletproof plates, etc. due to excellent impact absorption, sound absorption/insulation, and explosion-proof characteristics thereof, and excellent mechanical properties thereof compared to general Al foam, and a method of manufacturing the same.

2. Description of the Related Art

Foam manufactured by dispersing hollow spheres such as cenospheres or hollow microspheres in a polymer matrix has been reported. This foam uses a method of impregnating a polymer with hollow spheres by using a high bonding force between the hollow spheres and the polymer. However, the polymer matrix foam has poor mechanical properties and thus may not be appropriately used as a structural material.

Foam using a metal matrix may be manufactured using a powder metallurgy method, a liquid pressing infiltration method, a stir casting method, or the like, and aluminum (Al) foam is commonly used for transport devices and buildings which require light weights. The Al foam has a light weight and excellent impact absorption, sound absorption/insulation, vibration damping, and explosion-proof characteristics and thus is used for vehicle bumper systems, building soundproofing equipment, bulletproof plates, etc.

As a casting method, a foaming method for making foam by adding a thickener and a foaming agent to molten metal has been commonly used. However, according to the foaming method, manufacturing costs are increased because the foaming agent is high-priced, and a defect rate is high because foaming process parameters are not easily controllable.

A method of manufacturing Al foam by dispersing hollow spheres in a metal matrix does not use a thickener and a foaming agent and thus may achieve lower manufacturing costs and material costs compared to the foaming method. As the method of dispersing hollow spheres in Al, a powder metallurgy method, a liquid pressing infiltration method, etc. have been reported. The powder metallurgy method performed by mixing Al powder with powder of hollow spheres exhibits a good dispersion but increases manufacturing costs due to characteristics of the powder metallurgy method. The liquid pressing infiltration method performed by putting powder of hollow spheres in a mold and then pressing and filling molten Al in the mold may achieve a good dispersion uniformity and excellent interfacial properties but have problems of a low productivity and a limited product size as a batch-type manufacturing method.

Currently, a casting method has been proposed as a method of dispersing hollow spheres in Al alloy. However, this method is a method of ultimately pouring molten metal into a mold and then pressing the molten metal and is not a method of simply dispersing hollow spheres in molten metal.

SUMMARY OF THE INVENTION

The present invention provides an aluminum (Al) alloy foam to which magnesium (Mg) is added and which is capable of greatly reducing manufacturing costs and is usable for vehicle bumper systems, building soundproofing equipment, bulletproof plates, etc. due to excellent impact absorption, sound absorption/insulation, and explosion-proof characteristics thereof, and excellent mechanical properties thereof compared to general Al foam, and a method of manufacturing the same. The present invention also provides an Al alloy foam having a light weight and excellent energy absorption, explosion-proof, and wear resistance characteristics, capable of maximizing the energy absorption characteristics and improving surface characteristics by providing a low density at an inside region thereof and providing a high density at a surface region thereof, and thus usable for bulletproof plates, brake disks, etc. which require bulletproof and wear resistance characteristics, and a method of manufacturing the same. However, the scope of the present invention is not limited thereto.

According to an aspect of the present invention, there is provided aluminum (Al) alloy foam.

The Al alloy foam includes an Al alloy matrix containing magnesium (Mg), and hollow ceramic spheres dispersed in the Al alloy matrix, and a reaction layer including a Mg—Al composite oxide is formed at an interface where the Al alloy matrix is in contact with the hollow ceramic spheres.

A density of the Al alloy foam may be higher at a surface region of the Al alloy foam compared to a middle region of the Al alloy foam.

A hardness of the Al alloy foam may be higher at a surface region of the Al alloy foam compared to a middle region of the Al alloy foam.

An aspect ratio between a major width and a minor width of the hollow ceramic spheres may be greater at a surface region of the Al alloy foam compared to a middle region of the Al alloy foam.

A content of Mg may be 2.0 wt % to 8.0 wt %.

The hollow ceramic spheres may have a particle size ranging from 125 μm to 500 μm, and a content of the hollow ceramic spheres may be 20 Vol. % to 50 Vol. %.

The Al alloy matrix may further contain silicon (Si), and a content of Si in the Al alloy matrix may be less than 1.0 wt %.

A dispersion uniformity (%) of the hollow ceramic spheres dispersed in the Al alloy matrix may be defined as shown in Equation 1 and may be 82% to 96%.

$$\text{Dispersion uniformity (\%)}=\{1-(\text{Standard deviation of fraction of hollow ceramic spheres}/\text{Average fraction of hollow ceramic spheres})\}\times 100 \quad \text{[Equation 1]}$$

According to another aspect of the present invention, there is provided a method of manufacturing aluminum (Al) alloy foam.

The method includes providing first Al alloy foam including an Al alloy matrix containing magnesium (Mg), and hollow ceramic spheres dispersed in the Al alloy matrix, wherein a reaction layer including a Mg—Al composite oxide is formed at an interface where the Al alloy matrix is in contact with the hollow ceramic spheres, and forming second Al alloy foam by rolling the first Al alloy foam while the first Al alloy foam is being heated in such a manner that a surface region thereof is higher in temperature than a middle region thereof.

The forming of the second Al alloy foam may include rolling the first Al alloy foam while the first Al alloy foam is being heated to a solid-liquid coexistence temperature of the Al alloy matrix.

The first Al alloy foam may include Mg: 2.0 wt % to 8.0 wt %, silicon (Si): 0 wt % to 1 wt %, and Al: the remainder, and the forming of the second Al alloy foam may include rolling the first Al alloy foam while the first Al alloy foam is being heated in a range of 530° C. to 630° C.

The forming of the second Al alloy foam may include rolling the first Al alloy foam to a reduction ratio of 5% to 25%.

According to another aspect of the present invention, there is provided a method of manufacturing aluminum (Al) alloy foam.

The method includes adding magnesium (Mg) to molten aluminum (Al) to form a molten Al alloy, and adding hollow ceramic spheres to the molten Al alloy by forming a vortex in the molten Al alloy by using a stirrer.

The forming of the vortex may include stirring the molten Al alloy by rotating the stirrer at a rotation speed ranging from 500 rpm to 1,200 rpm.

The stirring of the molten Al alloy may include stirring the molten Al alloy at a temperature ranging from 750° C. to 850° C.

The method may further include preheating the hollow ceramic spheres to a temperature ranging from 100° C. to 180° C., before the adding of the hollow ceramic spheres.

A content of Mg may be 2.0 wt % to 8.0 wt %.

The hollow ceramic spheres may have a particle size ranging from 125 μm to 500 μm, and a content of the hollow ceramic spheres may be 20 Vol. % to 50 Vol. %.

BRIEF DESCRIPTION OF THE DRAWINGS

The above and other features and advantages of the present invention will become more apparent by describing in detail embodiments thereof with reference to the attached drawings in which.

DETAILED DESCRIPTION OF THE INVENTION

Figure 1A:
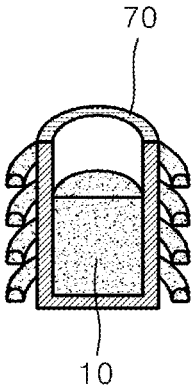
FIGS. 1(*a*) to 1(*e*) include images for describing sequential steps of a method of manufacturing an aluminum (Al) alloy foam sample, according to an embodiment of the present invention.
Figure 1B:
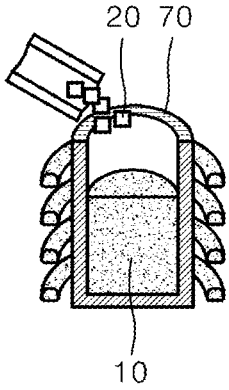
Figure 1C:
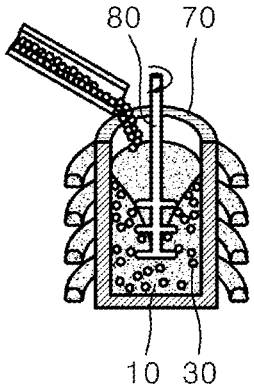
Figure 1D:
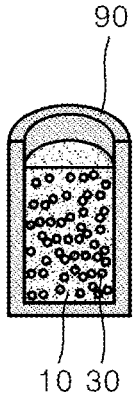
Figure 1E:
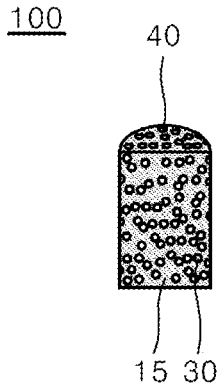

Hereinafter, the present invention will be described in detail by explaining embodiments of the invention with reference to the attached drawings. The invention may, however, be embodied in many different forms and should not be construed as being limited to the embodiments set forth herein; rather, these embodiments are provided so that this disclosure will be thorough and complete, and will fully convey the concept of the invention to one of ordinary skill in the art.

FIGS. 1(*a*) to 1(*e*) include images for describing sequential steps of a method of manufacturing an aluminum (Al) alloy foam sample, according to an embodiment of the present invention.

Initially, referring to FIG. 1(*a*), molten Al 10 is prepared by putting and melting Al in a furnace 70. Then, as illustrated in FIG. 1(*b*), a molten Al alloy 10 containing magnesium (Mg) is produced by adding Mg 20 to the prepared molten Al 10.

As illustrated in FIG. 1(*c*), a vortex is formed in the molten Al alloy 10 containing Mg by rotating a stirrer 80, and hollow ceramic spheres 30 are added to the molten Al alloy 10 containing Mg and having the vortex formed therein.

According to an embodiment of the present invention, by putting the hollow ceramic spheres 30 in the molten Al alloy 10 by forming the vortex in the molten Al alloy 10 by using the stirrer 80, active reaction is induced between the molten Al alloy 10 and the hollow ceramic spheres 30 during the stirring process.

Al alloy foam casted after the stirring process exhibits a high bonding force between the Al alloy matrix and the hollow ceramic spheres, and it is regarded that the high bonding force is achieved because a Mg—Al composite oxide reaction layer capable of increasing a bonding force is formed at an interface where the Al alloy matrix is in contact with the hollow ceramic spheres. A detailed description thereof will be provided below.

Herein, to form the vortex, the molten Al alloy 10 may be stirred by rotating the stirrer 80 at a rotation speed ranging from 500 rpm to 1,200 rpm. In this case, the molten Al alloy 10 is stirred at a temperature ranging from 750° C. to 850° C. Before being added to the molten Al alloy 10, the hollow ceramic spheres 30 are preheated to a temperature ranging from 100° C. to 180° C.

As illustrated in FIG. 1(*d*), the molten Al alloy 10 containing Mg and having the hollow ceramic spheres 30 uniformly dispersed therein is put and cooled in a mold 90. Then, as illustrated in FIG. 1(*e*), the mold 90 is removed and thus Al alloy foam 100 according to an embodiment of the present invention is manufactured.

Referring to FIG. 1(*e*), the Al alloy foam 100 according to an embodiment of the present invention includes an Al alloy matrix 15 containing Mg, and the hollow ceramic spheres 30 dispersed in the Al alloy matrix 15. In this case, a reaction layer 40 is formed at an interface where the Al alloy matrix 15 is in contact with the hollow ceramic spheres 30. Herein, the content of Mg added to the Al alloy 15 may be 2.0 wt % to 8.0 wt %, and the content of the hollow ceramic spheres 30 may be 20 Vol. % to 50 Vol. %. The content of silicon (Si) included in the Al alloy 15 may be less than 1.0 wt %.

The hollow ceramic spheres 30 may include, for example, cenospheres which are lightweight particles included in fly ashes produced in a large quantity at thermal power plants and treated as waste. In this case, a resource recycling effect may be achieved and thus a manufacturing cost reduction effect may also be achieved. The hollow ceramic spheres 30 may have, for example, a particle size ranging from 125 μm to 500 μm.

A dispersion uniformity (%) of the hollow ceramic spheres 30 dispersed in the Al alloy 15 is defined as shown in Equation 1 and satisfies 82% to 96%.

$$\text{Dispersion uniformity (\%)}=\{1-(\text{Standard deviation of fraction of hollow ceramic spheres}/\text{Average fraction of hollow ceramic spheres})\}\times 100 \quad \text{[Equation 1]}$$

Meanwhile, a bonding force is increased by the hollow ceramic spheres 30 dispersed in the Al alloy 15, and the reaction layer 40 formed at the interface where the Al alloy 15 is in contact with the hollow ceramic spheres 30. The reaction layer 40 includes, for example, secondary phase magnesium aluminate ($MgAl_2O_4$).

In the present invention, formation of the reaction layer 40 serves as a significant factor. When the above-described cenospheres are used as the hollow ceramic spheres 30, the amount of Mg to be added is critical to achieve a sufficient bonding force between the Al alloy matrix and the cenospheres. When Mg is not added, because reaction does not occur between the Al alloy and the cenospheres, an interface bonding force is remarkably reduced and thus the cenospheres are not uniformly dispersed in the Al alloy.

Meanwhile, chemical reaction occurs between the molten Al alloy 10 to which Mg is added, and the cenospheres during the stirring process. The cenospheres include a compound or a composite oxide of $SiO_2$ and $Al_2O_3$ and react with the molten Al alloy 10 containing Mg, as shown in Chemical Formulas (1) to (3).

$$2Al(l)+Mg(l)+2SiO_2(s)\rightarrow 2MgAl_2O_4(S)+2Si(S) \quad \text{Chemical Formula (1):}$$

$$Mg(l)+4/3Al_2O_3(s)\rightarrow MgAl_2O_4(s)+2/3Al(l) \quad \text{Chemical Formula (2):}$$

$$3Mg(l)+Al_2O_3\rightarrow 3MgO(s)+2Al(l) \quad \text{Chemical Formula (3):}$$

Because chemical reaction occurs as shown in Chemical Formulas (1) to (3), the bonding force between the Al alloy matrix and the cenospheres is increased. Herein, activity of Mg in the molten metal is increased in proportion to the content of Mg in the Al alloy and thus an increase in the content of Mg in the Al alloy is advantageous to increase reactivity with the cenospheres.

However, when Mg is added by more than a certain amount, oxidation of Mg in the molten Al alloy is increased and reactivity with the cenospheres is also increased rapidly. Therefore, in the present invention, the content of Mg added to the Al alloy 15 is controlled to be 2.0 wt % to 8.0 wt %. When the content of Mg is less than 2.0 wt %, reactivity with the hollow ceramic spheres 30 is not sufficient and thus the hollow ceramic spheres 30 may not be uniformly dispersed in the Al alloy matrix. Otherwise, when the content of Mg is greater than 8.0 wt %, oxidation of the molten Al alloy is increased and excessive reactivity with the hollow ceramic spheres 30 occurs.

In the molten Al alloy 10, chemical reaction occurs between Si and Mg as shown in Chemical Formula (4) and thus secondary phase magnesium silicide ($Mg_2Si$) is formed in the Al alloy matrix.

$$2Mg(l)+Si(l)\rightarrow Mg_2Si(s) \quad \text{Chemical Formula (4):}$$

When the amount of Si added to the Al alloy matrix is increased, the content of Mg in the matrix is reduced and thus chemical reaction expressed by Chemical Formulas (1) to (3) is hindered. Therefore, Si is not added or is added by limiting the content thereof to be less than 1.0 wt % such that chemical reaction between the molten Al alloy and the cenospheres is preferentially induced and unique characteristics of the Al alloy foam are sufficiently exhibited.

Meanwhile, the hollow ceramic spheres 30 may penetrate into the molten Al alloy 10 by forming the vortex by strongly stirring the molten Al alloy 10. In this case, when a stirring speed of the molten Al alloy 10 is lower than a certain speed, the hollow ceramic spheres 30 may not penetrate into the molten Al alloy 10 due to a low density of the hollow ceramic spheres 30. Otherwise, when the stirring speed of the molten Al alloy 10 is higher than a certain speed, the molten Al alloy 10 is spilled out due to centrifugal force of the molten Al alloy 10. Therefore, an appropriate rotation speed of the stirrer 80 may be 500 rpm to 1,200 rpm. Herein, the stirrer 80 may have a variety of shapes to form the vortex of the molten Al alloy 10 and to uniformly disperse the hollow ceramic spheres 30.

The molten Al alloy 10 may be stirred at a temperature of 750° C. to 850° C. When the temperature is lower than 750° C., uniform dispersion may not be achieved due to a reduction in reactivity between the molten Al alloy 10 and the hollow ceramic spheres 30, and the molten Al alloy 10 may not be easily stirred due to an increase in viscosity of the molten Al alloy 10. Otherwise, when the temperature is higher than 850° C., a reaction product is created by an unnecessarily large amount and oxidation of Mg in the molten Al alloy 10 becomes severe due to excessive reaction between the molten Al alloy 10 and the hollow ceramic spheres 30.

A stirring time of the molten Al alloy 10 influences reaction between the molten Al alloy and the hollow ceramic spheres, and dispersion uniformity. A molten metal stirring time longer than a certain time is required to induce reaction between the molten Al alloy and the hollow ceramic spheres and to achieve uniform dispersion. However, when the stirring time of the molten Al alloy 10 is increased, a reaction product is excessively created and thus fluidity of the molten metal is rapidly reduced. Therefore, in the present invention, the stirring time of the molten Al alloy 10 is limited to a range from 1 minute to 5 minutes.

When the hollow ceramic spheres 30 are inserted into the molten Al alloy 10, to prevent a rapid reduction in temperature of the molten metal, the hollow ceramic spheres 30 are preheated at a temperature of 100° C. to 180° C. to remove moisture therefrom and then is added to the molten Al alloy 10.

The hollow ceramic spheres 30 have a particle size ranging from 125 μm to 500 μm. When the particle size of the hollow ceramic spheres 30 is reduced, a surface area of particles of the hollow ceramic spheres 30 is increased. As such, when inserted into the molten Al alloy 10, a reduction in the temperature of the molten metal is promoted due to an increase in a contact area between the molten metal and the hollow ceramic spheres 30, and influence of a surface tension between the molten Al alloy 10 and the hollow ceramic spheres 30 becomes remarkable. Therefore, when the particle size of the hollow ceramic spheres 30 is less than 125 μm, the hollow ceramic spheres 30 are not uniformly dispersed in the molten Al alloy 10 due to the reduction in the temperature of the molten metal and the influence of the surface tension.

Otherwise, when the particle size of the hollow ceramic spheres 30 is greater than 500 μm, influence of buoyancy by an inert gas in the hollow ceramic spheres 30 is remarkable compared to the case when the particle size is less than 500 μm, and thus the hollow ceramic spheres 30 may not be easily mixed with and stirred in the molten Al alloy 10.

In the present invention, the hollow ceramic spheres 30 are added by a content of 20 Vol. % to 50 Vol. %. When the content of the hollow ceramic spheres 30 is less than 20 Vol. %, unique characteristics of the Al alloy foam may not be sufficiently exhibited. Otherwise, when the content of the hollow ceramic spheres 30 is greater than 50 Vol. %, powder of the hollow ceramic spheres 30 does not completely penetrate into the molten Al alloy 10 and rises to the surface of the molten metal, and fluidity of the molten metal is rapidly reduced to disable a casting process.

The Al alloy foam 100 according to an embodiment of the present invention may include the hollow ceramic spheres 30 uniformly dispersed in the Al alloy 15, have excellent energy absorption characteristics and mechanical properties, and be used for vehicle bumper systems, building sound-proofing equipment, bulletproof plates, etc.

Figure 8:
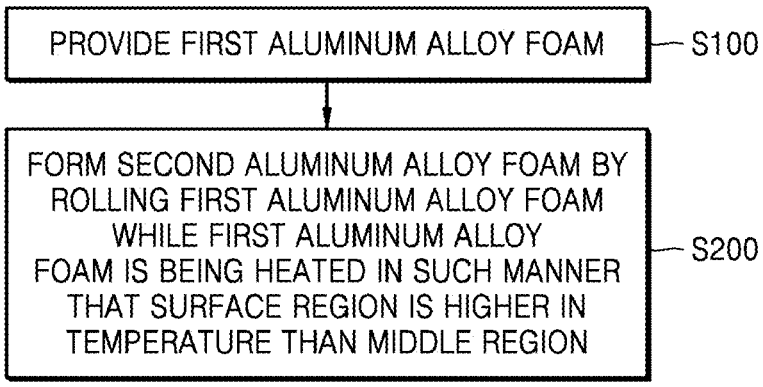
FIG. 8 is a flowchart of a method of manufacturing an Al alloy foam sample, according to another embodiment of the present invention.
Figure 9:
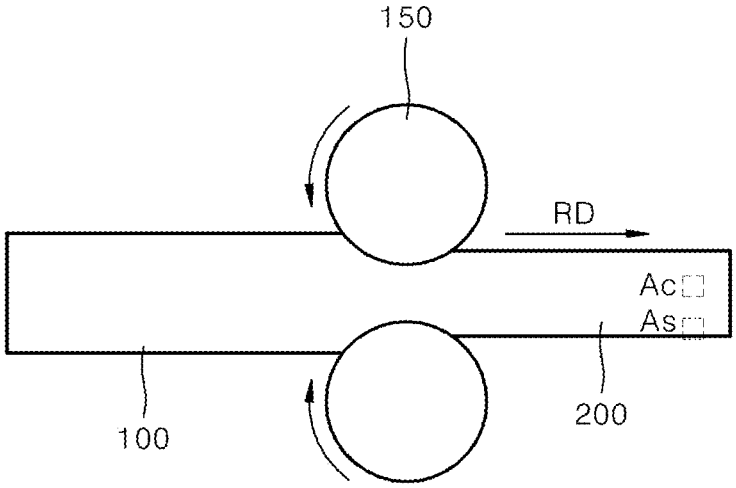
FIG. 9 is a cross-sectional view for describing the method of manufacturing the Al alloy foam sample, according to another embodiment of the present invention.

FIG. 8 is a flowchart of a method of manufacturing an Al alloy foam sample, according to another embodiment of the present invention, and FIG. 9 is a cross-sectional view for describing the method of manufacturing the Al alloy foam sample, according to another embodiment of the present invention.

Referring to FIGS. 8 and 9, the method of manufacturing the Al alloy foam sample, according to another embodiment of the present invention, includes providing first Al alloy foam 100 including an Al alloy matrix containing Mg, and hollow ceramic spheres dispersed in the Al alloy matrix, wherein a reaction layer including a Mg—Al composite oxide is formed at an interface where the Al alloy matrix is in contact with the hollow ceramic spheres (S100), and forming second Al alloy foam 200 by rolling the first Al alloy foam 100 while the first Al alloy foam 100 is being heated in such a manner that a surface region As thereof is higher in temperature than a middle region Ac thereof (S200).

The first Al alloy foam 100 corresponds to the Al alloy foam described above in relation to FIGS. 1(*a*) to 7(*d*). Therefore, a detailed description of the first Al alloy foam 100 will not be repeatedly provided herein.

The second Al alloy foam 200 is formed by rolling the first Al alloy foam 100 by using rollers 150 while the first Al alloy foam 100 is being heated in such a manner that the surface region As is higher in temperature than the middle region Ac. The forming of the second Al alloy foam 200 (S200) may include rolling the first Al alloy foam 100 to a reduction ratio of 5% to 25%.

The first Al alloy foam 100 needs to be heated before the forming of the second Al alloy foam 200 (S200), and the first Al alloy foam 100 should be rolled while the first Al alloy foam 100 is being heated in such a manner that the surface region As is higher in temperature than the middle region Ac. When the Al alloy foam between steps FIG. 1(*d*) and FIG. 1(*e*) is rolled, a surface region of the Al alloy foam is lower in temperature than a middle region thereof and thus the above-described second Al alloy foam 200 may not be formed. That is, to form the second Al alloy foam 200, the first Al alloy foam 100 after step FIG. 1(*e*) should be rolled while the first Al alloy foam 100 is being heated in such a manner that the surface region As is higher in temperature than the middle region Ac.

Specifically, the forming of the second Al alloy foam 200 (S200) may include rolling the first Al alloy foam 100 while the first Al alloy foam 100 is being heated to a solid-liquid coexistence temperature of the Al alloy matrix. More specifically, the first Al alloy foam 100 includes Mg: 2.0 wt % to 8.0 wt %, Si: 0 wt % to 1 wt %, and Al: the remainder and, in this case, the forming of the second Al alloy foam 200 (S200) may include rolling the first Al alloy foam 100 while the first Al alloy foam 100 is being heated in a range of 530° C. to 630° C.

A density-graded Al alloy foam may be achieved using the second Al alloy foam 200 formed according to the above-described manufacturing method. In this case, a density at the surface region As of the second Al alloy foam 200 may be higher than the density at the middle region Ac of the second Al alloy foam 200.

A hardness of the second Al alloy foam 200 as the density-graded Al alloy foam may be higher at the surface region As compared to the middle region Ac. Furthermore, in the second Al alloy foam 200 as the density-graded Al alloy foam, an aspect ratio between a major width and a minor width of the hollow ceramic spheres may be greater at the surface region As of the second Al alloy foam 200 compared to the middle region Ac of the second Al alloy foam 200.

The second Al alloy foam 200 may have a graded density from the surface region to the middle region thereof. To this end, the first Al alloy foam 100 to be rolled may be heated in such a manner that the temperature is gradually reduced from the surface region As to the middle region Ac.

The above-described second Al alloy foam 200 may have a light weight and excellent energy absorption, explosion-proof, and wear resistance characteristics, maximize the energy absorption characteristics and improve surface characteristics by providing a low density at an inside region thereof and providing a high density at a surface region thereof, and thus be used for bulletproof plates, brake disks, etc. which require bulletproof and wear resistance characteristics.

Functionality of a material may be maximized by gradually varying properties of the material depending on locations like a functionally graded material and, with regard to metal foam, density-graded foam in which a volume fraction of voids therein varies depending on locations is advantageous in terms of energy absorption and bulletproof characteristics. However, a pressing infiltration method using a separately prepared precursor, a method of bonding foam sheets having various void densities, or a three-dimensional (3D) printing method using specific metal powder should be used to form the density-graded foam, and thus high production costs and difficulty in mass production are predicted due to complexity of processes. According to the afore-described embodiment of the present invention, manufacturing costs may be greatly reduced by manufacturing Al—Mg-based alloy foam by using a stir casting method, and energy absorption characteristics may be maximized and surface characteristics may be improved by providing a graded density in a material. Particularly, because a powder metallurgy method, a pressing infiltration method, or a 3D printing method is not used, manufacturing costs may be reduced and mass production may be enabled.

Test examples for promoting understanding of the present invention will now be described. However, the following test examples are merely to promote understanding of the present invention and the present invention is not limited thereto.

Test Examples 1

Al alloy foam samples were manufactured using a method of manufacturing Al alloy foam, according to Test Examples 1 of the present invention. Table 1 shows manufacturing conditions, dispersions, and dispersion uniformities of Al alloy foam samples according to embodiments of the present invention. Table 2 shows manufacturing conditions, dispersions, and dispersion uniformities of Al alloy foam samples according to comparative examples of the present invention. In the dispersion item of Tables 1 and 2, '○' indicates a good dispersion, 'X' indicates a poor dispersion, and 'Δ' indicates an average dispersion.

TABLE 1

| Embodiment | Mg Content (Wt. %) | Si Content (Wt. %) | Cenosphere Type | Cenosphere Content (Vol. %) | Cenosphere Average Particle Size (μm) | Aspect Ratio (Shell Diameter:Shell Thickness) | Cenosphere Preheating Temperature (° C.) | Stirring Temperature (° C.) | Molten Metal Temperature (° C.) | Pouring Temperature (° C.) | Dispersion (○/Δ/χ) | Dispersion Uniformity (%) |
|---|---|---|---|---|---|---|---|---|---|---|---|---|
| 1 | 3 | <1 | C1 | 30 | 475 | 28:1 | 100~180 | 750~850 | 750~800 | >800 | ○ | 96 |
| 2 | 3 | <1 | C2 | 30 | 136 | 25:1 | 100~180 | 750~850 | 750~800 | >800 | ○ | 83 |
| 3 | 3 | <1 | C2 | 40 | 136 | 25:1 | 100~180 | 750~850 | 750~800 | >800 | ○ | 82 |
| 4 | 3 | <1 | C2 | 50 | 136 | 25:1 | 100~180 | 750~850 | 750~800 | >800 | ○ | 85 |
| 5 | 4.5 | <1 | C2 | 30 | 136 | 25:1 | 100~180 | 750~850 | 750~800 | >800 | ○ | 88 |

TABLE 2

| Comparative Example | Mg Content (Wt. %) | Si Content (Wt. %) | Cenosphere Type | Cenosphere Content (Vol. %) | Cenosphere Average Particle Size (μm) | Aspect Ratio (Shell Diameter:Shell Thickness) | Cenosphere Preheating Temperature (° C.) | Stirring Temperature (° C.) | Molten Metal Temperature (° C.) | Pouring Temperature (° C.) | Dispersion (○/Δ/χ) | Dispersion Uniformity (%) |
|---|---|---|---|---|---|---|---|---|---|---|---|---|
| 1 | 0 | 0 | C2 | 30 | 136 | 25:1 | 100~200 | — | 750 | 800 | X | 0 |
| 2 | 0 | 10 | C2 | 30 | 136 | 25:1 | 100~200 | 750~850 | 750 | 800 | X | 0 |
| 3 | 0.5 | <1 | C2 | 30 | 136 | 25:1 | 100~200 | 750~850 | 750 | 800 | X | 0 |
| 4 | 1 | <1 | C3 | 50 | 117 | 31:1 | 100~200 | 750~850 | 750 | 800 | X | 0 |
| 5 | 2.5 | <1 | C3 | 50 | 117 | 31:1 | 100~200 | 750~850 | 750 | 800 | X | 0 |
| 6 | 3 | <1 | C3 | 30 | 117 | 31:1 | 100~200 | 750~850 | 750 | 800 | X | 0 |
| 7 | 3 | <1 | C1 | 15 | 475 | 28:1 | 100~180 | 750~850 | 750~800 | <800 | Δ | 13 |
| 8 | 3 | <1 | C2 | 15 | 136 | 25:1 | 100~180 | 750~850 | 750~800 | >800 | Δ | 12 |
| 9 | 3 | <1 | C3 | 15 | 117 | 31:1 | 100~180 | 750~850 | 750~800 | >800 | X | 0 |
| 10 | 7 | <1 | C3 | 50 | 117 | 31:1 | 100~200 | 750~850 | 750 | 800 | X | 0 |

Figure 2A:
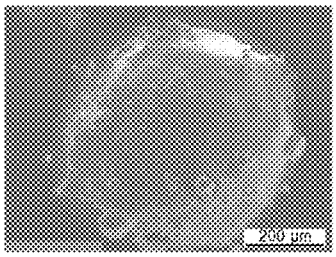
FIGS. 2(*a*) to 2(*c*) include scanning electron microscope (SEM) images showing microstructures of hollow ceramic spheres according to test examples of the present invention.
Figure 2B:
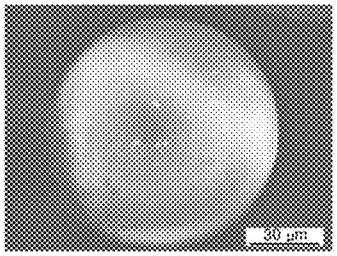
Figure 2C:
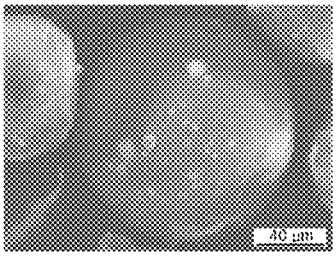

FIGS. 2(*a*) to 2(*c*) include scanning electron microscope (SEM) images showing surface microstructures of different types of cenospheres used as hollow ceramic spheres in Test Examples 1 of the present invention. Particle sizes of the different types of cenospheres are measured as shown in Table 3.

TABLE 3

| Sample | Average Particle Size (μm) | Measured Particle Size (μm) |
|---|---|---|
| C1 | 450 | 475 |
| C2 | 180 | 136 |
| C3 | 100 | 117 |

Initially, referring to Tables 1 and 3, the Al alloy foam samples according to the embodiments among Test Examples 1 include an Al alloy matrix containing Mg, and hollow ceramic spheres dispersed in the Al alloy matrix, wherein the content of Mg satisfies a range of 2.0 wt % to 8.0 wt %, the content of the hollow ceramic spheres satisfies a range of 20 Vol. % to 50 Vol. %, the content of Si in the Al alloy matrix satisfies a range less than 1.0 wt %, and the hollow ceramic spheres satisfy a particle size ranging from 125 μm to 500 μm. The method of manufacturing the Al alloy foam samples according to the embodiments among Test Examples 1 include adding Mg ranging from 2.0 wt % to 8.0 wt %, to molten Al to form a molten Al alloy, and adding hollow ceramic spheres to the molten Al alloy by forming a vortex in the molten Al alloy by using a stirrer, wherein a stirring temperature of the molten Al alloy satisfies a range of 750° C. to 850° C., and a preheating temperature of the hollow ceramic spheres before the hollow ceramic spheres are added satisfies a range of 100° C. to 180° C.

In the Al alloy foam samples according to the embodiments of the present invention, which satisfy all of the above conditions, it is shown that the hollow ceramic spheres dispersed in the Al alloy matrix exhibits a good dispersion uniformity satisfying a range of 82% to 96%.

Meanwhile, referring to Tables 2 and 3, in Comparative Examples 1 to 4 among Test Examples 1, unlike the embodiments, the content of Mg from among the above-described process conditions does not satisfy a range of 2.0 wt % to 8.0 wt %. In Comparative Example 2 among Test Examples 1, unlike the embodiments, the content of Si in the Al alloy matrix from among the above-described process conditions does not satisfy a range less than 1.0 wt %. In Comparative Examples 4 to 6, 9, and 10 among Test Examples 1, unlike the embodiments, a particle size of the hollow ceramic spheres from among the above-described process conditions does not satisfy a range of 125 μm to 500 μm. In Comparative Examples 7 to 9 among Test Examples 1, unlike the embodiments, the content of the hollow ceramic spheres from among the above-described process conditions does not satisfy a range of 20 Vol. % to 50 Vol. %.

In the Al alloy foam samples according to the comparative examples of the present invention, it is shown that the hollow ceramic spheres dispersed in the Al alloy matrix exhibit a poor dispersion uniformity of 0% to 13%.

Figure 3A:
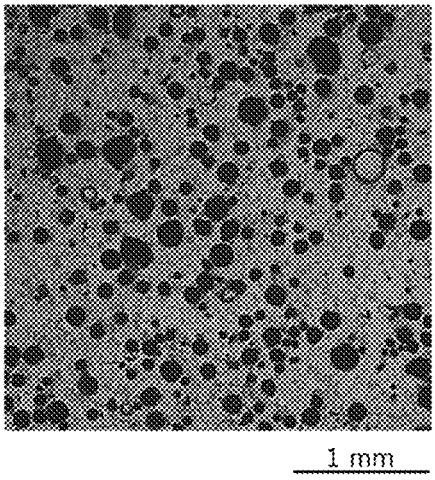
FIGS. 3(*a*) to 3(*b*) include optical microscope images showing microstructures of Al alloy foam samples according to test examples of the present invention.
Figure 3B:
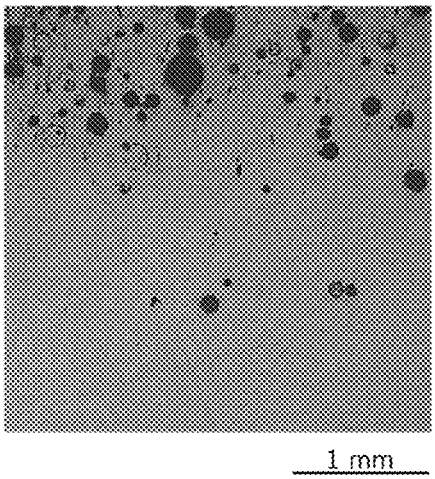

FIGS. 3(*a*) to 3(*b*) include optical microscope images showing microstructures of Al alloy foam samples according to Test Examples 1 of the present invention.

FIG. 3(*a*) shows the microstructure of the sample of Embodiment 2 of the present invention, and FIG. 3(*b*) shows the microstructure of the sample of Comparative Example 3 of the present invention. The sample of Embodiment 2 shows that cenospheres are uniformly dispersed in the Al alloy matrix. On the other hand, the sample of Comparative Example 3 shows that cenospheres are provided only at a specific part of the Al alloy matrix and are not dispersed. This means that the same type of cenospheres are dispersed differently depending on the content of Mg under the same process conditions and that an appropriate amount of Mg is required to uniformly disperse cenospheres.

Figure 4A:
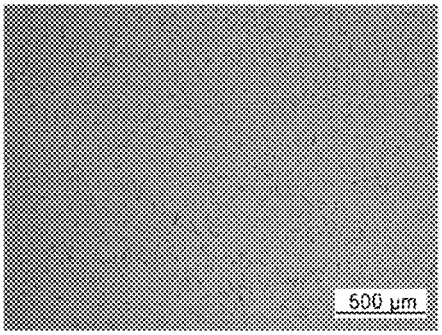
FIGS. 4(*a*) to 4(*b*) include optical microscope images showing microstructures of an Al alloy foam sample according to a test example of the present invention.
Figure 4B:
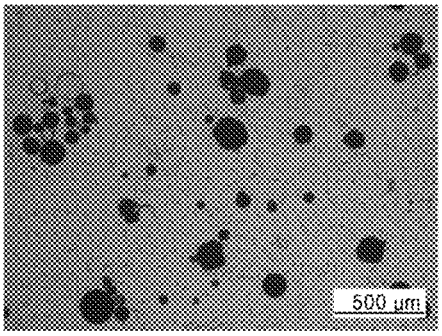

FIGS. 4(*a*) to 4(*b*) include optical microscope images showing microstructures of the sample of Comparative Example 8 at different locations. FIG. 4(*a*) shows the microstructure at an inside region of the casted Al foam, and FIG. 4(*b*) shows the microstructure at an outside region of the casted Al foam.

The sample of Comparative Example 8 shows that cenospheres are partially dispersed at the outside region of the Al alloy foam but cenospheres are not dispersed at all at the inside region of the Al alloy foam. This means that, because the sample of Comparative Example 8 has the same content of Mg as that of the sample of Embodiment 2 illustrated in FIG. 3(*a*) but has a low content of cenospheres of 15 Vol. %, the content of cenospheres should be at least higher than that to exhibit unique characteristics of the Al alloy foam.

Figure 5A:
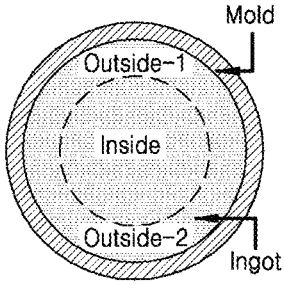
FIG. 5(*a*) includes a cross-sectional view and FIG. 5(*b*) includes a graph comparatively showing degrees of dispersion of Al alloy foam samples according to test examples of the present invention.
Figure 5B:
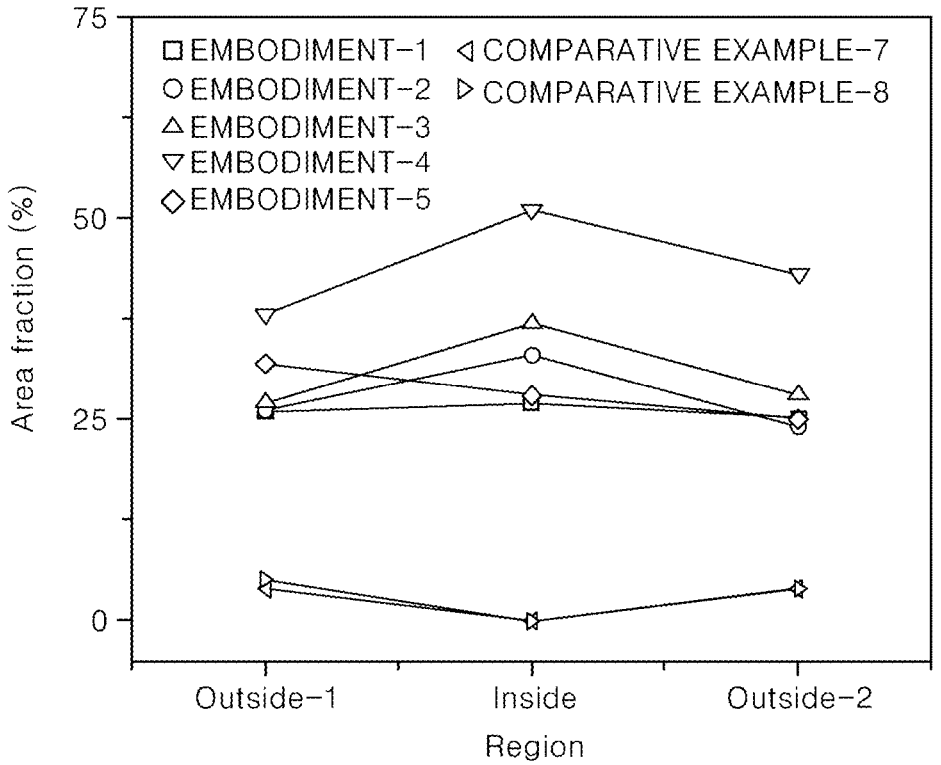

FIG. 5(*a*) includes a cross-sectional view and FIG. 5(*b*) includes a graph comparatively showing degrees of dispersion of Al alloy foam samples according to test examples of the present invention.

FIG. 5(*a*) is a cross-sectional view schematically showing different locations in a sample to compare the degrees of dispersion of the Al alloy foam samples, and FIG. 5(*b*) is a graph comparatively showing the degrees of dispersion of the Al alloy foam samples at the locations shown in FIG. 5(*a*). FIG. 5(*b*) shows degrees of dispersion of the hollow ceramic spheres at different locations in each foam sample, and the above-described dispersion uniformity thereof is calculated using Equation 1 based on the degrees of dispersion of FIG. 5(*b*).

Referring to FIG. 5(*b*), it is shown that the degrees of dispersion of the samples of Embodiments 1 to 5 of the present invention are higher than those of the samples of Comparative Examples 7 and 8 to varying degrees. The samples of Comparative Examples 7 and 8 have a low content of cenospheres of 15 Vol. % and thus exhibit poor dispersion under the same other process conditions. On the other hand, the samples of Embodiments 1 to 5 satisfy a content range of cenospheres greater than 30 Vol. %, and exhibit good dispersion uniformities in the Al alloy.

Figure 6:
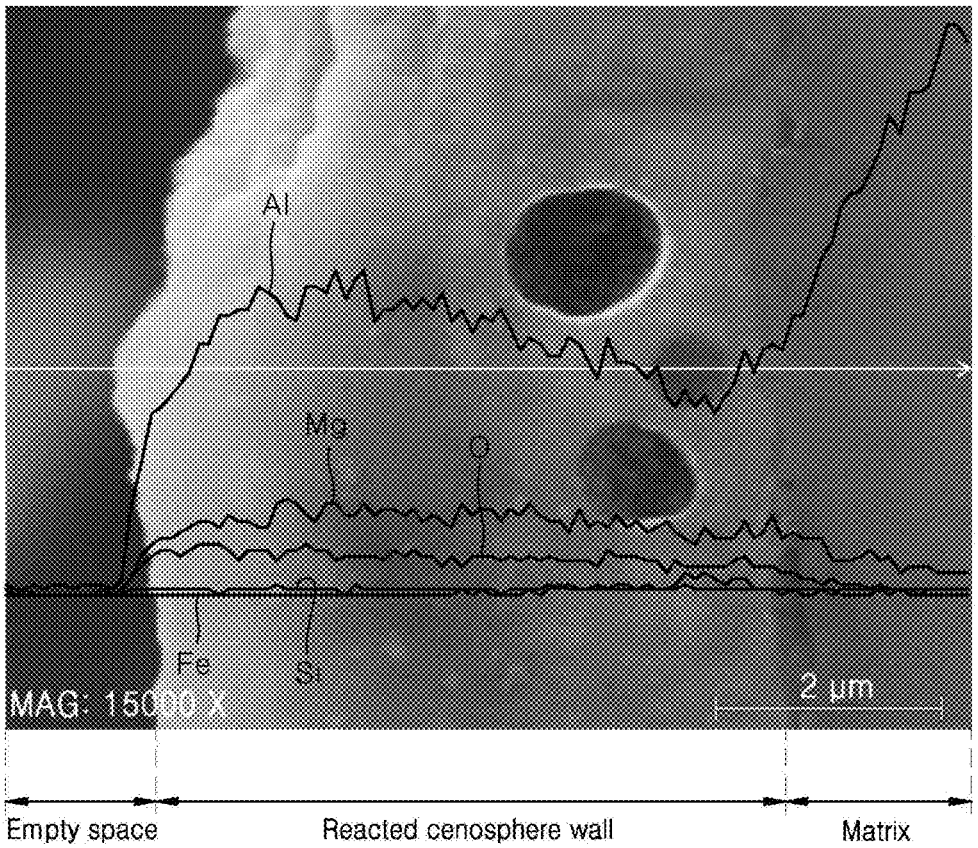
FIG. 6 is a SEM image showing an interface microstructure of an Al alloy foam sample according to a test example of the present invention, based on energy dispersive spectroscopy.
Figure 7A:
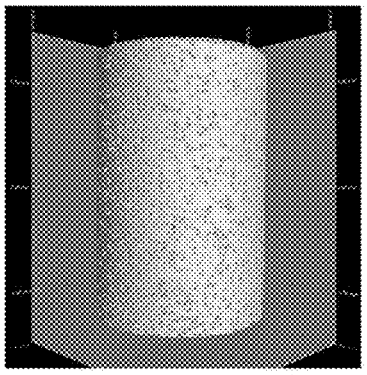
FIGS. 7(*a*) to 7(*d*) include micro-computed tomography (micro-CT) images of an Al alloy foam sample according to a test example of the present invention.
Figure 7B:
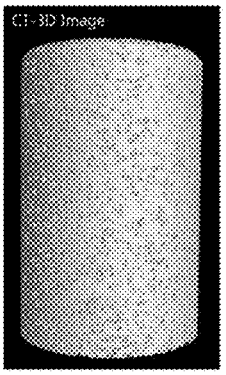
Figure 7C:
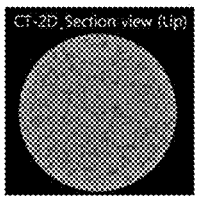
Figure 7D:
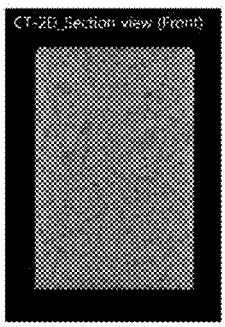

FIG. 6 is a SEM image showing an interface microstructure of an Al alloy foam sample according to Test Example 1 of the present invention, based on energy dispersive spectroscopy.

Referring to FIG. 6, the microstructure line-scanned along an interface where the Al alloy is in contact with the cenospheres in the sample of Embodiment 2 shows that secondary phase $MgAl_2O_4$ is formed at the interface. This means that an appropriate amount of Mg should be added to achieve a bonding force between the Al alloy matrix and the cenospheres and that the secondary phase $MgAl_2O_4$ is formed due to chemical reaction occurring between the molten Al alloy to which Mg is added, and the cenospheres during the stirring process.

FIGS. 7(*a*) to 7(*d*) include micro-computed tomography (micro-CT) images of an Al alloy foam sample according to Test Example 1 of the present invention.

FIGS. 7(*a*) to 7(*d*) include includes micro-CT images of the sample of Embodiment 2 of the present invention, and shows the cenospheres are uniformly dispersed not only at an outside surface region but also at an inside region of the Al alloy.

Test Examples 2

Figure 10A:
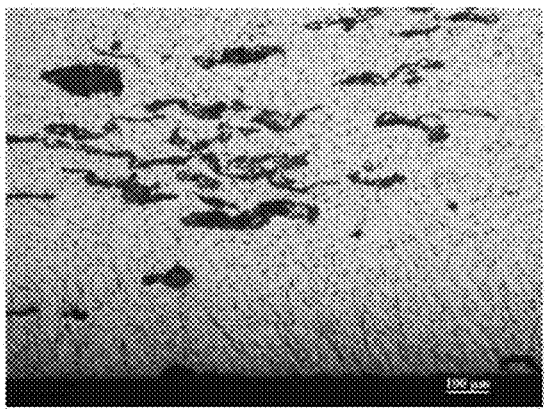
FIG. 10(*a*) includes magnified images of tissues of a surface region and FIG. 10(*b*) includes magnified images of tissues of a middle region of a sample of an embodiment among test examples of the present invention.
Figure 10B:
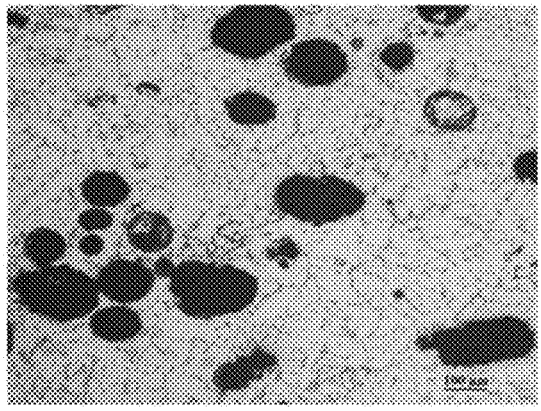

Tables 4 and 5 show conditions for and physical properties of samples of Test Examples 2 of the present invention. FIG. 10(*a*) and FIG. 10(*b*) include magnified images of tissues of the surface region As and the middle region Ac of the sample of Embodiment 8 among Test Examples 2 of the present invention, respectively.

In Test Examples 2 of the present invention, Mg was added to achieve a bonding force and to improve wettability between an Al matrix and cenospheres. Furthermore, addition of Mg is required to extend a solid-liquid coexistence temperature range for solid-liquid coexistence temperature rolling for providing a graded density. Therefore, in the present invention, Mg may be added by 2 wt % to 8 wt %. To provide a graded density in Al foam, an Al foam plate was heated at a solid-liquid coexistence temperature of 580° C. for 1 hour and then was rolled. In this case, the heating time of the plate should be determined in such a manner that the temperature of a surface region of the plate sufficiently reaches the solid-liquid coexistence temperature and is gradually reduced to an inside region of the plate. To this end, the heating time should be adjusted based on a thickness of the plate. In Test Examples 2, a plate having a thickness of 20 mm was heated for 1 hour. Multi-pass rolling was performed and, ultimately, a reduction ratio of 15% to 20% was applied. Wear characteristics of the plate were evaluated using a ball-on-disc test at a normal load of 50 N and a linear velocity of 0.5 m/s.

TABLE 4

| | Mg Content (wt %) | Cenosphere Volume Fraction (%) | Reduction Ratio (%) | Density ($g/cm^3$) | Surface Density ($g/cm^3$) | Middle Density ($g/cm^3$) | Cenosphere Aspect Ratio (Surface) | Cenosphere Aspect Ratio (Middle) |
|---|---|---|---|---|---|---|---|---|
| Comparative Example 11 | 3 | 30 | 0% | 2.265 | 2.27 | 2.27 | 1.1 | 1.1 |
| Embodiment 6 | 3 | 30 | 15% | 2.277 | 2.95 | 2.06 | 2.4 | 1.3 |
| Embodiment 7 | 3 | 30 | 20% | 2.257 | 2.95 | 2.06 | 3.4 | 1.3 |

TABLE 4-continued

| | Mg Content (wt %) | Cenosphere Volume Fraction (%) | Reduction Ratio (%) | Density ($g/cm^3$) | Surface Density ($g/cm^3$) | Middle Density ($g/cm^3$) | Cenosphere Aspect Ratio (Surface) | Cenosphere Aspect Ratio (Middle) |
|---|---|---|---|---|---|---|---|---|
| Comparative Example 12 | 7 | 30 | 0% | 2.211 | 2.21 | 2.21 | 1.0 | 1.0 |
| Embodiment 8 | 7 | 30 | 20% (1%/pass) | 2.373 | 2.91 | 2.02 | 3.6 | 1.6 |
| Embodiment 9 | 7 | 30 | 20% (5%/pass) | 2.4 | 2.91 | 2.02 | 3.2 | 1.6 |

TABLE 5

| | Mg Content (wt %) | Cenosphere Volume Fraction (%) | Reduction Ratio (%) | Surface Hardness (HV) | Middle Hardness (HV) | Wear Rate ($mm^3/m$) | Friction Coefficient (μ) |
|---|---|---|---|---|---|---|---|
| Comparative Example 11 | 3 | 30 | 0% | 51.2 | 51.2 | 0.00439 | 0.90745 |
| Embodiment 6 | 3 | 30 | 15% | 68.8 | 54.1 | 0.001695 | 0.063799 |
| Embodiment 7 | 3 | 30 | 20% | 70.5 | 67.4 | 0.001666 | 0.168995 |
| Comparative Example 12 | 7 | 30 | 0% | 65.1 | 65.1 | 0.00382 | 0.37154 |
| Embodiment 8 | 7 | 30 | 20% (1%/pass) | 67.2 | 59.3 | 0.00558 | 0.1854 |
| Embodiment 9 | 7 | 30 | 20% (5%/pass) | 60.3 | 57.4 | 0.00237 | 0.04026 |

The Al alloy foam samples according to Test Examples 2 of the present invention are divided into first Al alloy foam samples (comparative examples) and second Al alloy foam samples (embodiments). Specifically, the samples of Comparative Examples 11 and 12 correspond to first Al alloy foam samples to which step S200 of FIG. 8 is not applied, and Embodiments 6 to 9 correspond to second Al alloy foam samples to which step S200 of FIG. 8 is applied. Specifically, the samples of Embodiments 6 and 7 achieve desired reduction ratios by performing 1-pass rolling in step S200 of FIG. 8, and Embodiments 8 and 9 achieve desired reduction ratios by performing multi-pass rolling in step S200 of FIG. 8.

Referring to Table 4 and FIGS. 10(*a*) to 10(*b*), in the comparative examples, the surface region As and the middle region Ac of the first Al alloy foam samples exhibit equal densities and also exhibit equal aspect ratios between a major width and a minor width of the hollow ceramic spheres. On the other hand, in the embodiments, the surface region As and the middle region Ac of the second Al alloy foam samples exhibit different densities and also exhibit different aspect ratios between the major width and the minor width of the hollow ceramic spheres. Specifically, in the second Al alloy foam samples, the density is higher at the surface region As compared to the middle region Ac and the aspect ratio between the major width and the minor width of the hollow ceramic spheres is greater at the surface region As compared to the middle region Ac.

[1] Referring to Table 5, in the comparative examples, the surface region As and the middle region Ac of the first Al alloy foam samples exhibit equal hardness values. On the other hand, in the embodiments, the surface region As and the middle region Ac of the second Al alloy foam samples exhibit different hardness values. Specifically, in the second Al alloy foam samples, the hardness is higher at the surface region As compared to the middle region Ac. Furthermore, under the same Mg content and cenosphere volume fraction conditions, compared to the first Al alloy foam samples according to the comparative examples, the second Al alloy foam samples according to the embodiments exhibit remarkably lower friction coefficients and mostly exhibit lower wear rates.

In brief, Table 4 shows that a density-graded Al alloy foam plate having a low density at an inside region thereof and having a high density at a surface region thereof may be manufactured, and Table 5 shows that the density-graded Al alloy foam plate may achieve a high surface hardness, a low wear rate, and a remarkably low friction coefficient.

According to the afore-described embodiments of the present invention, Al alloy foam capable of greatly reducing manufacturing costs compared to a general powder metallurgy method may be provided by using a stir casting method. In addition, the Al alloy foam of the present invention may achieve remarkable resource recycling and manufacturing cost reduction effects by using cenospheres which are lightweight particles included in fly ashes treated as waste. Furthermore, a method of manufacturing Al alloy foam, the method being capable of achieving a remarkable manufacturing cost reduction effect because a thickener and a foaming agent are not added compared to a general foam casting method and because a manufacturing process is simple and pressing is not performed in a casting process compared to a liquid pressing infiltration method may be provided. However, the scope of the present invention is not limited to the above-described effects.

While the present invention has been particularly shown and described with reference to embodiments thereof, it will be understood by one of ordinary skill in the art that various changes in form and details may be made therein without departing from the scope of the present invention as defined by the following claims.

What is claimed is:

1. Aluminum (Al) alloy foam comprising:

an Al alloy matrix containing magnesium (Mg); and hollow ceramic spheres dispersed in the Al alloy matrix, wherein a reaction layer comprising a Mg—Al composite oxide is formed at an interface where the Al alloy matrix is in contact with the hollow ceramic spheres.

2. The Al alloy foam of claim 1, wherein a density of the Al alloy foam is higher at a surface region of the Al alloy foam compared to a middle region of the Al alloy foam.

3. The Al alloy foam of claim 1, wherein a hardness of the Al alloy foam is higher at a surface region of the Al alloy foam compared to a middle region of the Al alloy foam.

4. The Al alloy foam of claim 1, wherein an aspect ratio between a major width and a minor width of the hollow ceramic spheres is greater at a surface region of the Al alloy foam compared to a middle region of the Al alloy foam.

5. The Al alloy foam of claim 1, wherein a content of Mg is 2.0 wt % to 8.0 wt %.

6. The Al alloy foam of claim 1, wherein the hollow ceramic spheres have a particle size ranging from 125 μm to 500 μm, and wherein a content of the hollow ceramic spheres is 20 Vol. % to 50 Vol. %.

7. The Al alloy foam of claim 1, wherein the Al alloy matrix further contains silicon (Si), and wherein a content of Si in the Al alloy matrix is less than 1.0 wt %.

8. The Al alloy foam of claim 1, wherein a dispersion uniformity (%) of the hollow ceramic spheres dispersed in the Al alloy matrix is defined as shown in Equation 1 and is 82% to 96%.

$$\text{Dispersion uniformity (\%)} = \{1 - (\text{Standard deviation of fraction of hollow ceramic spheres}/\text{Average fraction of hollow ceramic spheres})\} \times 100 \quad \text{[Equation 1]}$$

9. A method of manufacturing aluminum (Al) alloy foam, the method comprising:

providing first Al alloy foam comprising an Al alloy matrix containing magnesium (Mg), and hollow ceramic spheres dispersed in the Al alloy matrix, wherein a reaction layer comprising a Mg—Al composite oxide is formed at an interface where the Al alloy matrix is in contact with the hollow ceramic spheres; and forming second Al alloy foam by rolling the first Al alloy foam while the first Al alloy foam is being heated in such a manner that a surface region of the first Al alloy foam is higher in temperature than a middle region of the first Al alloy foam.

10. The method of claim 9, wherein the forming of the second Al alloy foam comprises rolling the first Al alloy foam while the first Al alloy foam is being heated to a solid-liquid coexistence temperature of the Al alloy matrix.

11. The method of claim 9, wherein the first Al alloy foam comprises Mg: 2.0 wt % to 8.0 wt %, silicon (Si): 0 wt % to 1 wt %, and Al: the remainder, and wherein the forming of the second Al alloy foam comprises rolling the first Al alloy foam while the first Al alloy foam is being heated in a range of 530° C. to 630° C.

12. The method of claim 9, wherein the forming of the second Al alloy foam comprises rolling the first Al alloy foam to a reduction ratio of 5% to 25%.

13. A method of manufacturing aluminum (Al) alloy foam, the method comprising:

adding magnesium (Mg) to molten aluminum (Al) to form a molten Al alloy; and adding hollow ceramic spheres to the molten Al alloy by forming a vortex in the molten Al alloy by using a stirrer.

14. The method of claim 13, wherein the forming of the vortex comprises stirring the molten Al alloy by rotating the stirrer at a rotation speed ranging from 500 rpm to 1,200 rpm.

15. The method of claim 14, wherein the stirring of the molten Al alloy comprises stirring the molten Al alloy at a temperature ranging from 750° C. to 850° C.

16. The method of claim 13, further comprising preheating the hollow ceramic spheres to a temperature ranging from 100° C. to 180° C., before the adding of the hollow ceramic spheres.

17. The method of claim 13, wherein a content of Mg is 2.0 wt % to 8.0 wt %.

18. The method of claim 13, wherein the hollow ceramic spheres have a particle size ranging from 125 μm to 500 μm, and wherein a content of the hollow ceramic spheres is 20 Vol. % to 50 Vol. %.

* * * * *